US011131046B2

(12) United States Patent
Gualtieri

(10) Patent No.: US 11,131,046 B2
(45) Date of Patent: Sep. 28, 2021

(54) MODULE AND SYSTEM FOR THE TREATMENT OF FIBRES FOR OBTAINING A NON-WOVEN FABRIC

(71) Applicant: Marco Gualtieri, Prato (IT)

(72) Inventor: Marco Gualtieri, Prato (IT)

( * ) Notice: Subject to any disclaimer, the term of this patent is extended or adjusted under 35 U.S.C. 154(b) by 469 days.

(21) Appl. No.: 15/949,459

(22) Filed: Apr. 10, 2018

(65) Prior Publication Data

US 2018/0291540 A1 Oct. 11, 2018

(30) Foreign Application Priority Data

Apr. 11, 2017 (IT) ..... 102017000039980

(51) Int. Cl.
*F27B 9/28* (2006.01)
*D04H 3/11* (2012.01)
(Continued)

(52) U.S. Cl.
CPC ..... *D04H 3/11* (2013.01); *D04H 1/54* (2013.01); *D04H 1/732* (2013.01); *D04H 1/736* (2013.01);
(Continued)

(58) Field of Classification Search
CPC .. F26B 13/00; F26B 5/047; F26B 3/06; F26B 21/02; F26B 21/004; F26B 3/10;
(Continued)

(56) References Cited

U.S. PATENT DOCUMENTS 4,303,387 A * 12/1981 Burke ..... F27B 9/28 431/72
5,441,242 A * 8/1995 Ebner ..... C21D 1/767 148/601
(Continued)

FOREIGN PATENT DOCUMENTS

EP 1291458 A2 3/2003
EP 2372279 A1 10/2011
(Continued)

OTHER PUBLICATIONS

Italian Search Report dated Oct. 17, 2017 from counterpart Italian Patent Application No. 201700039980.
(Continued)

*Primary Examiner* — Gregory A Wilson
(74) *Attorney, Agent, or Firm* — Shuttleworth & Ingersoll, PLC; Timothy Klima

(57) ABSTRACT

Described is a module for the treatment of fibres for obtaining a non-woven fabric. The module comprises a fan unit configured for generating a flow of air through a closed path and a chamber for the treatment of the fibres positioned in fluid communication with the closed path, delimited on opposite sides by respective side panels.
Each side panel comprises a first gap defining a blowing portion of the closed path and a second gap defining a suction portion of the closed path. Each side panel defines a branch of the closed path which extends between the fan unit and the treatment chamber.
The module also comprises a first platform and a second platform comprising respective first and second channels
(Continued)

placed in fluid communication with the first gap and second gap of each side panel and with the treatment chamber to define connecting portions of the closed path.

The fan unit is positioned equidistant relative to the treatment chamber in such a way that the flow of air is divided symmetrically between the branches of the closed path.

10 Claims, 7 Drawing Sheets

(51) Int. Cl.

| | |
|---|---|
| ***D04H 1/732*** | (2012.01) |
| ***D06C 7/00*** | (2006.01) |
| ***D06B 3/00*** | (2006.01) |
| ***D04H 1/736*** | (2012.01) |
| ***D06B 1/00*** | (2006.01) |
| ***D04H 1/54*** | (2012.01) |

(52) U.S. Cl.
CPC ..... *D06B 1/00* (2013.01); *D06B 3/00* (2013.01); *D06C 7/00* (2013.01)

(58) Field of Classification Search
CPC . F27B 9/28; F27B 9/14; F27B 9/3005; C21D 9/54
See application file for complete search history.

(56) References Cited

U.S. PATENT DOCUMENTS

| | | | | |
|---|---|---|---|---|
| 8,663,547 | B2 * | 3/2014 | Crafton | F27B 9/20 266/259 |
| 10,480,115 | B2 * | 11/2019 | Henry | F26B 13/00 |
| 10,724,794 | B2 * | 7/2020 | Niklaus | F26B 21/02 |
| 2006/0208378 | A1 | 9/2006 | Khambete et al. | |
| 2016/0251780 | A1 | 9/2016 | Hayashi et al. | |

FOREIGN PATENT DOCUMENTS

| | | | |
|---|---|---|---|
| EP | 2699722 | A1 | 2/2014 |
| EP | 3358061 | * | 2/2017 |

OTHER PUBLICATIONS

European Search Report dated Sep. 18, 2018 from counterpart European Patent Application No. 18166447.5.

* cited by examiner

MODULE AND SYSTEM FOR THE TREATMENT OF FIBRES FOR OBTAINING A NON-WOVEN FABRIC

CROSS REFERENCE TO RELATED APPLICATION

This application is a U.S. Non-provisional filing, which claims priority to IT Application No. 102017000039980, filed on Apr. 11, 2015, the entire disclosure of which is hereby incorporated herein by reference.

BACKGROUND

This invention relates to a module for the treatment of fibres. More specifically, the invention relates to a module for the treatment of fibres for obtaining a non-woven fabric.

Moreover, the invention relates to a system for the treatment of fibres for obtaining a non-woven fabric.

The term non-woven fabric means a product obtained with processes different from those used for obtaining a fabric consisting of weft and warp and obtained by weaving.

The non-woven fabrics are used in various industrial fields such as, for example building works, the automotive sector, packaging or some types of clothing.

The processes used in the making of the non-woven fabric comprise placing the fibres randomly, forming various layers which are joined to each other mechanically or with thermal processes.

As a result, unlike normal fabrics where the fibres are mainly interwoven at right angles to each other (weft/warp), non-woven fabrics have a completely random arrangement.

Of particular interest, with reference to the invention, are the thermal processes for obtaining non-woven fabrics.

A known thermal process, for example, comprises the use of a burner for heating the air which will strike the fibres for treating them thermally.

The thermal treatment takes place inside a suitable structure equipped with movement means for carrying the fibres in which the burner is positioned on a side of the structure.

SUMMARY OF THE INVENTION

The Applicant has found that the positioning of the burner on the side leads to a non-uniform heating of the air and hence a non-uniform treatment of the fibres.

A possible solution could be that of providing another burner on the side opposite to the first burner, thus rendering uniform the heating of the air and therefore of the treatment.

Disadvantageously, this solution requires larger spaces for the structure as well as a greater use of resources for powering the two burners simultaneously.

A similar argument may be made for the means for dissipating the heat, which with the use of a single extraction unit are not able to uniformly and adequately cool the fibres.

Even more disadvantageously, prior art structures for the treatment of the fibres have a shape such that the maintenance of them is difficult, in particular during the relative cleaning.

The aim of this invention is therefore to provide a module and a system for the treatment of fibres for obtaining a non-woven fabric which allows the drawbacks of the prior art to be overcome.

More specifically, an aim of the invention is to provide a module and a system for the treatment of fibres for obtaining a non-woven fabric which allows the fibres to be treated uniformly (both in terms of a heating module and a cooling module).

Even more specifically, the aim of the invention is to provide a module and a system for the treatment of fibres for obtaining a non-woven fabric for which the maintenance is easy to implement in the entire structure.

The technical purpose indicated and the aims specified are substantially achieved by a module and a system for the treatment of fibres for obtaining a non-woven fabric comprising the features described in one or more of the appended claims. The dependent claims correspond to possible embodiments of the invention.

Further features and advantages of the invention are more apparent in the non-limiting description which follows of a module for the treatment of fibres for obtaining a non-woven fabric.

BRIEF DESCRIPTION OF THE DRAWINGS

The description is set out below with reference to the accompanying drawings which are provided solely for purposes of illustration without restricting the scope of the invention and in which.

DETAILED DESCRIPTION

Figure 1:
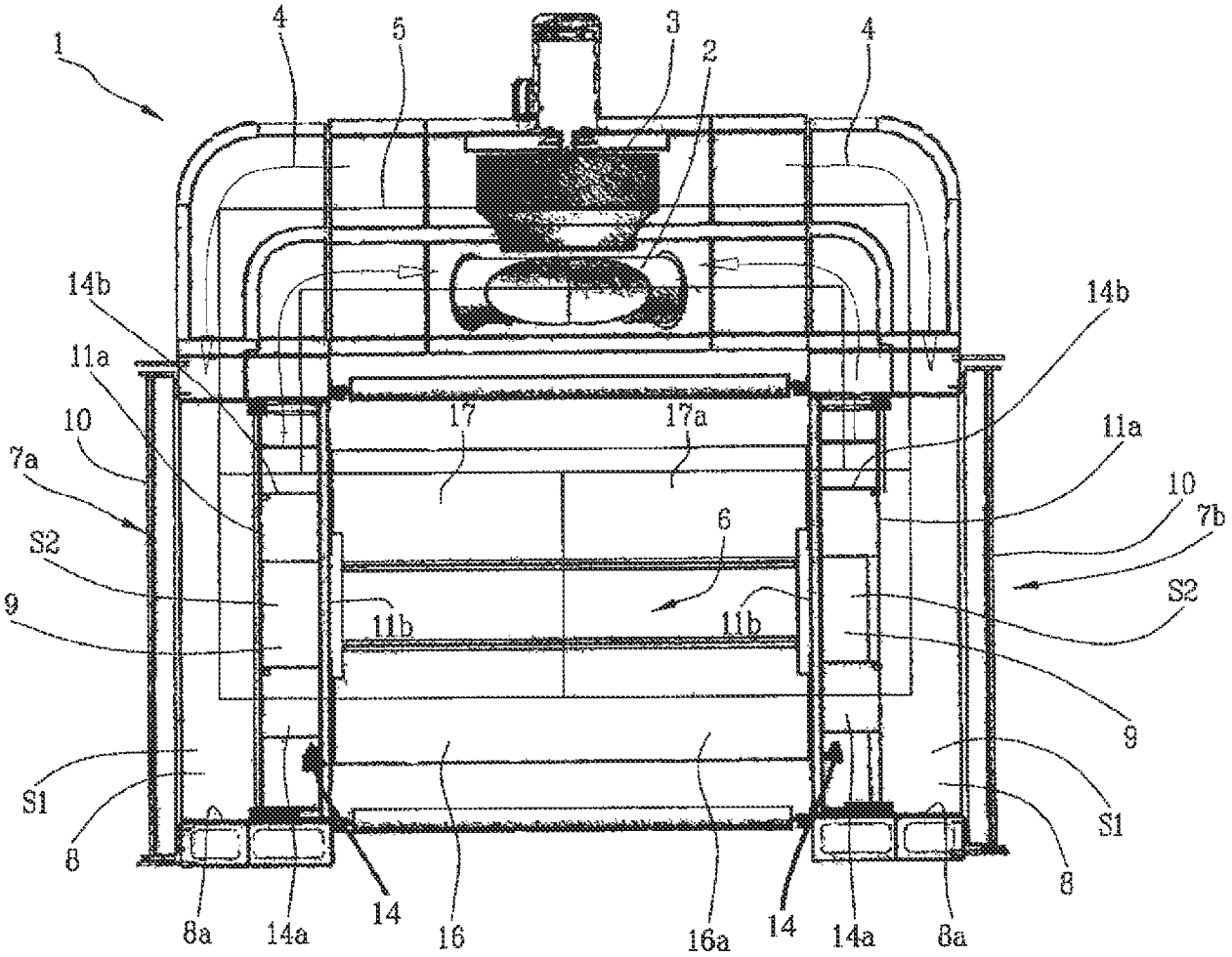
FIG. 1 is a schematic front cross section view of the module according to the invention.

With reference to the accompanying drawings, the numerals 1 and 1*a* denote in its entirety a module for the treatment of fibres for obtaining a non-woven fabric in accordance with the invention.

The elements in common in the accompanying drawings are denoted with the same reference numeral.

For simplicity of description, the module for the treatment of fibres 1 described in the accompanying drawings comprises a burner 2 being designed to act as a module for heating the fibres which, for simplicity, will be referred to hereafter as the module 1.

The module 1 comprises a fan unit 3 positioned at the burner 2. The fan unit 3 is configured for obtaining a flow of air 4. The flow of air 4 is placed in continuous circulation through the fan unit 3, whilst the burner 2 has the purpose of heating the flow of air 4.

The flow of air 4 travels inside the module 1 through a closed path 5.

The closed path 5 is configured in such a way that the flow of hot air 4 can strike the fibres and then be redirected to the fan unit 3 to be again heated by the burner 2.

The module 1 comprises a chamber 6 for treatment of the fibres.

The treatment chamber 6 is positioned in fluid communication with the closed path 5 in such a way that the flow of air 4 can pass through the fibres and treat them thermally.

The module 1 comprises two side panel 7*a* and 7*b* which delimit the treatment chamber 6 laterally.

Each side panel 7*a* and 7*b* comprises a first gap 8 and a second gap 9.

Each side panel 7*a* and 7*b* defines a branch of the closed path 5 which extends between the fan unit 3 and the treatment chamber 6.

The fan unit 3 is positioned equidistant relative to the treatment chamber 6 in such a way that the flow of air 4 is divided symmetrically between the branches of the closed path 5.

The fan unit 3 is positioned above the treatment chamber 6.

This arrangement of the fan unit 3 forms a closed path portal.

The first gap 8 defines a blowing portion S1 of the closed path 5.

Figure 2:
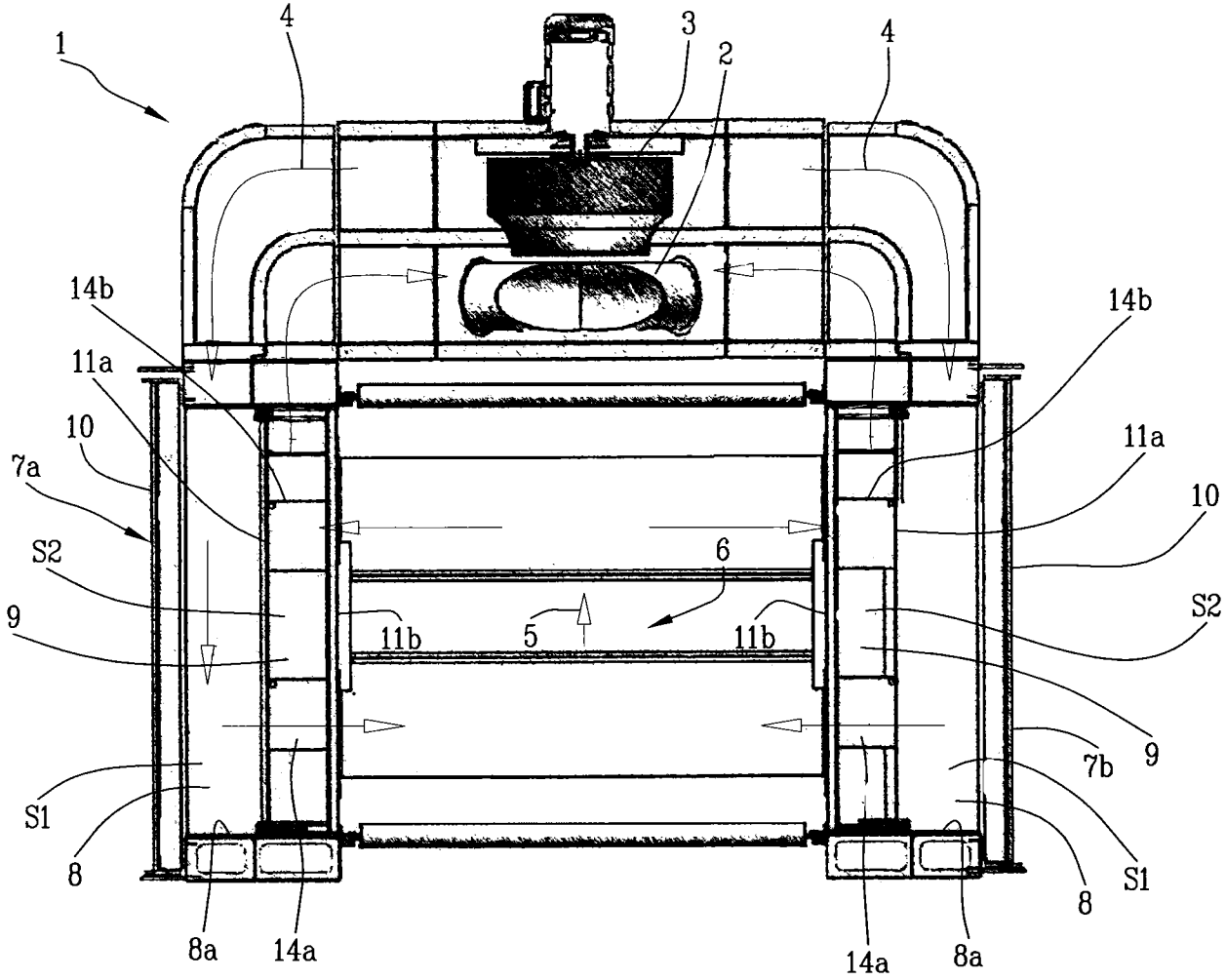
FIG. 2 is a schematic front cross section view of the module according to the invention in a first operational configuration.
Figure 3:
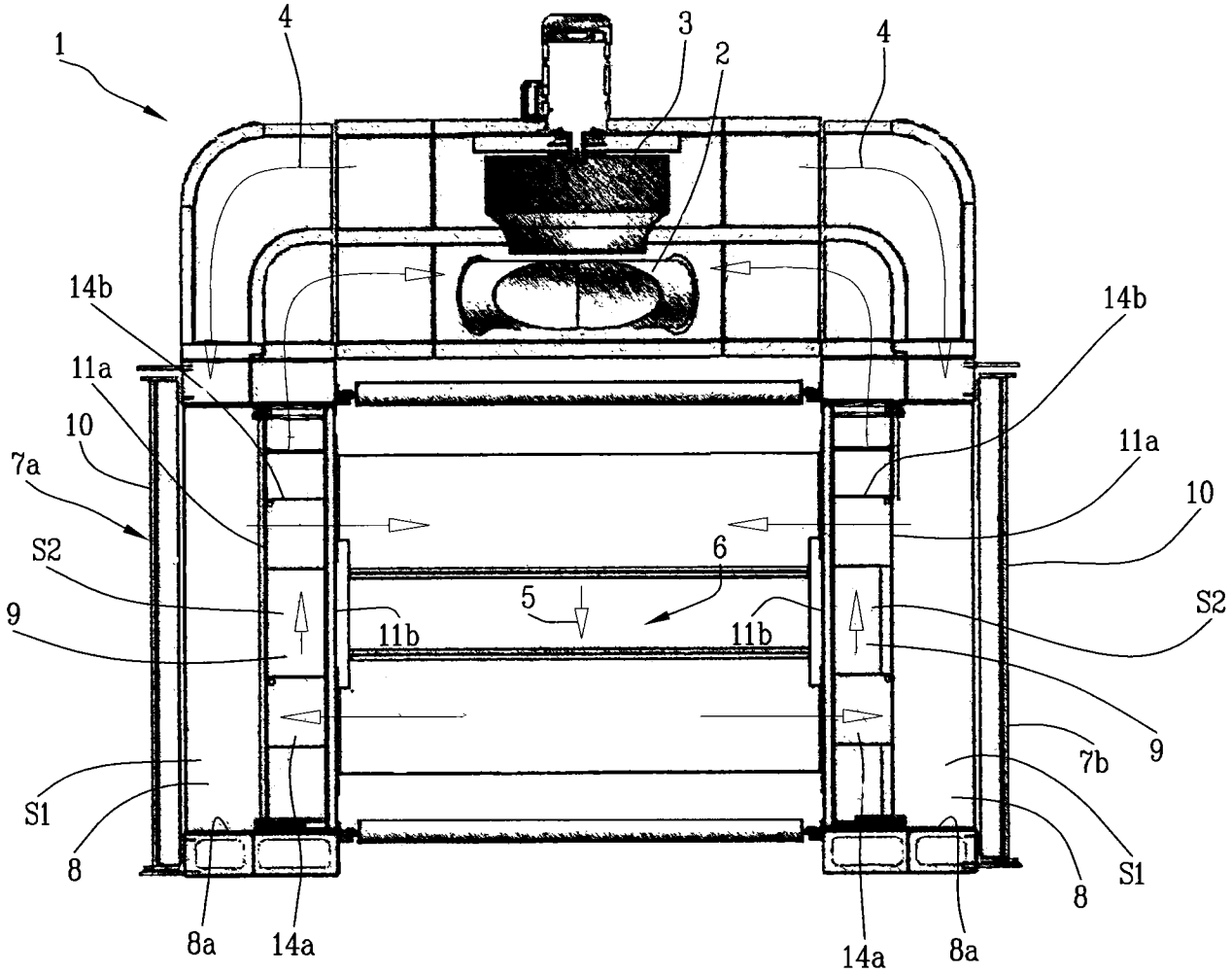
FIG. 3 is a schematic front cross section view of the module according to the invention in a second operational configuration.

In FIGS. 1 to 3 this blowing portion S1 is connected directly with the fan unit 3 (and therefore to the burner 2) thus defining the start of the closed path 5.

The first gap 8 is delimited by an outer door 10.

Figure 4:
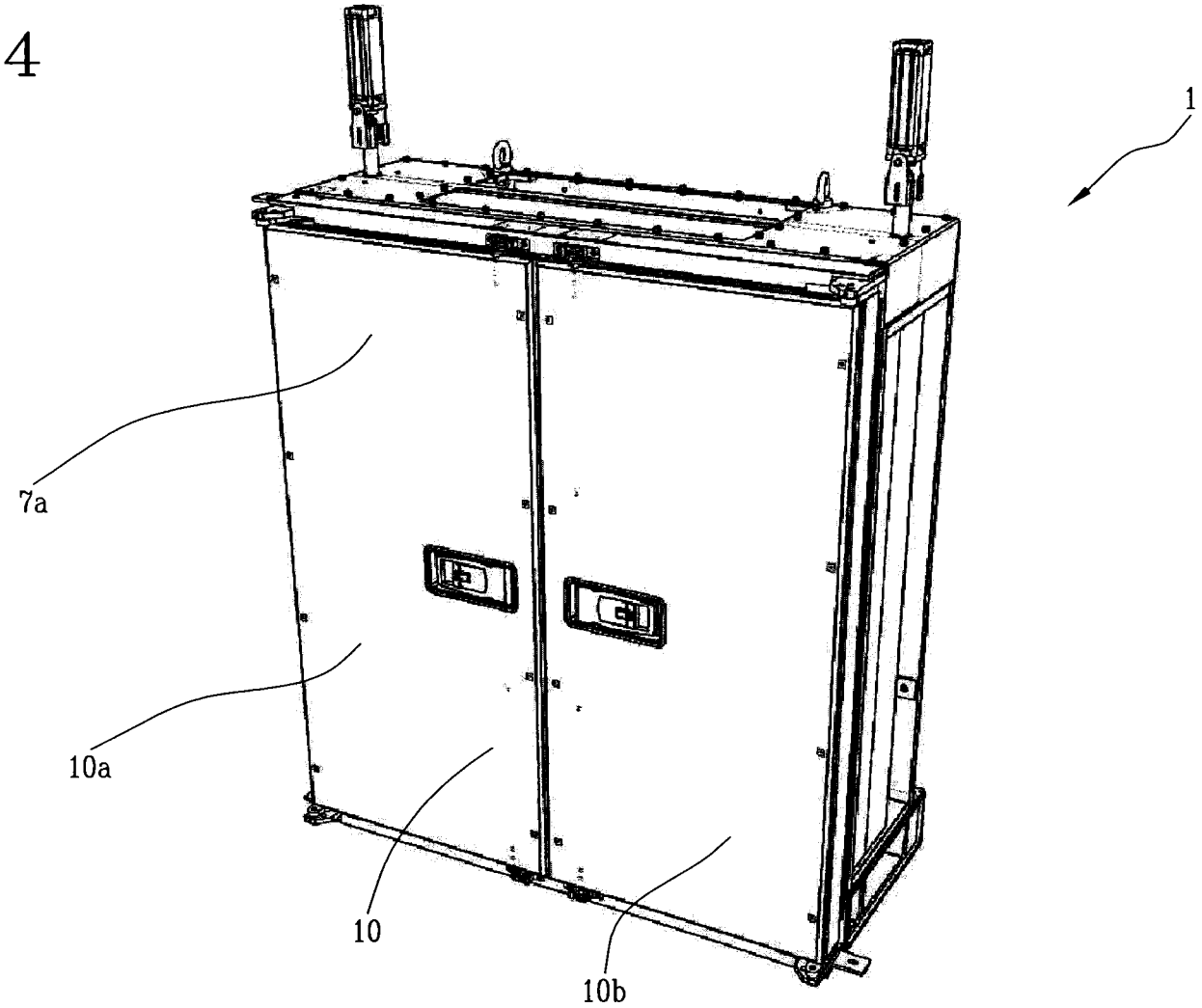
FIGS. 4 to 6 are schematic side views of a detail of the module according to the invention in different configurations.

The outer door 10 can be opened for accessing inside the module 1. Preferably, the outer door 10 is of the hinged type (and is defined by a first hinge 10*a* and a second hinge 10*b* shown in FIGS. 4 and 5).

Figure 5:
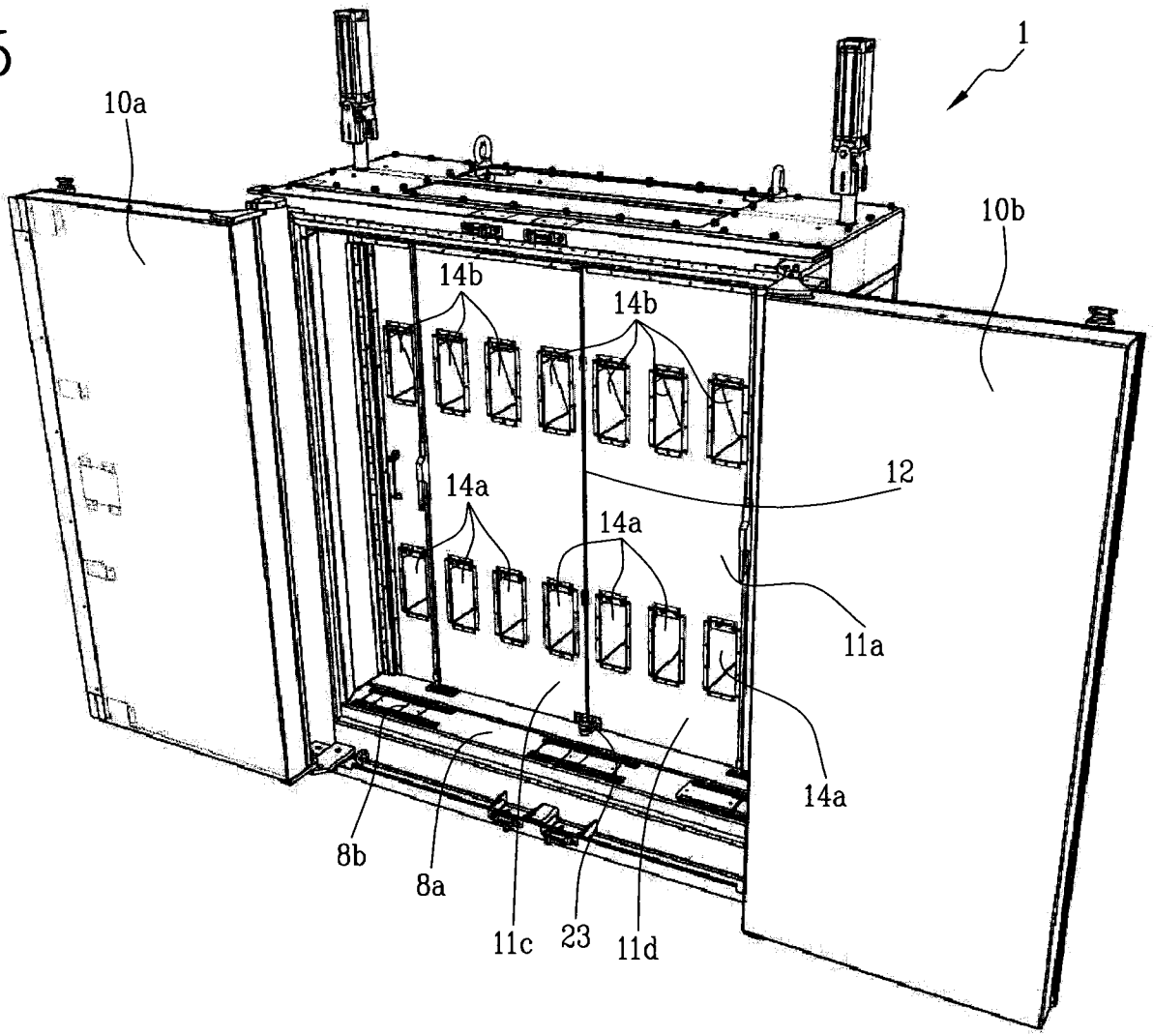

Even more preferably, as illustrated in FIG. 5, the outer door 10 can be opened outwards so that the ledges 10*a* and 10*b* do not make contact with other components of the module, facilitating the entrance of an operator who must carry out the maintenance of the module 1.

Moreover, the first gap 8 is delimited by a base surface 8*a* equipped with recovery openings 8*b* for recovering a portion of the air flow 4.

The recovery openings 8*b* are positioned in fluid communication with a recovery duct 8*c* comprising an adjustable suction unit 8*d* for regulating the quantity of the portion of the air flow 4 to be recovered.

Advantageously, the duct 8*c* is configured in such a way as to carry the flow of air 4 extracted from the module 1 towards a preheating station 22 located before the module 1.

The second gap 9 defines a suction portion S2.

The second gap 9 is positioned between the first gap 8 and the treatment chamber 6.

Figure 6:
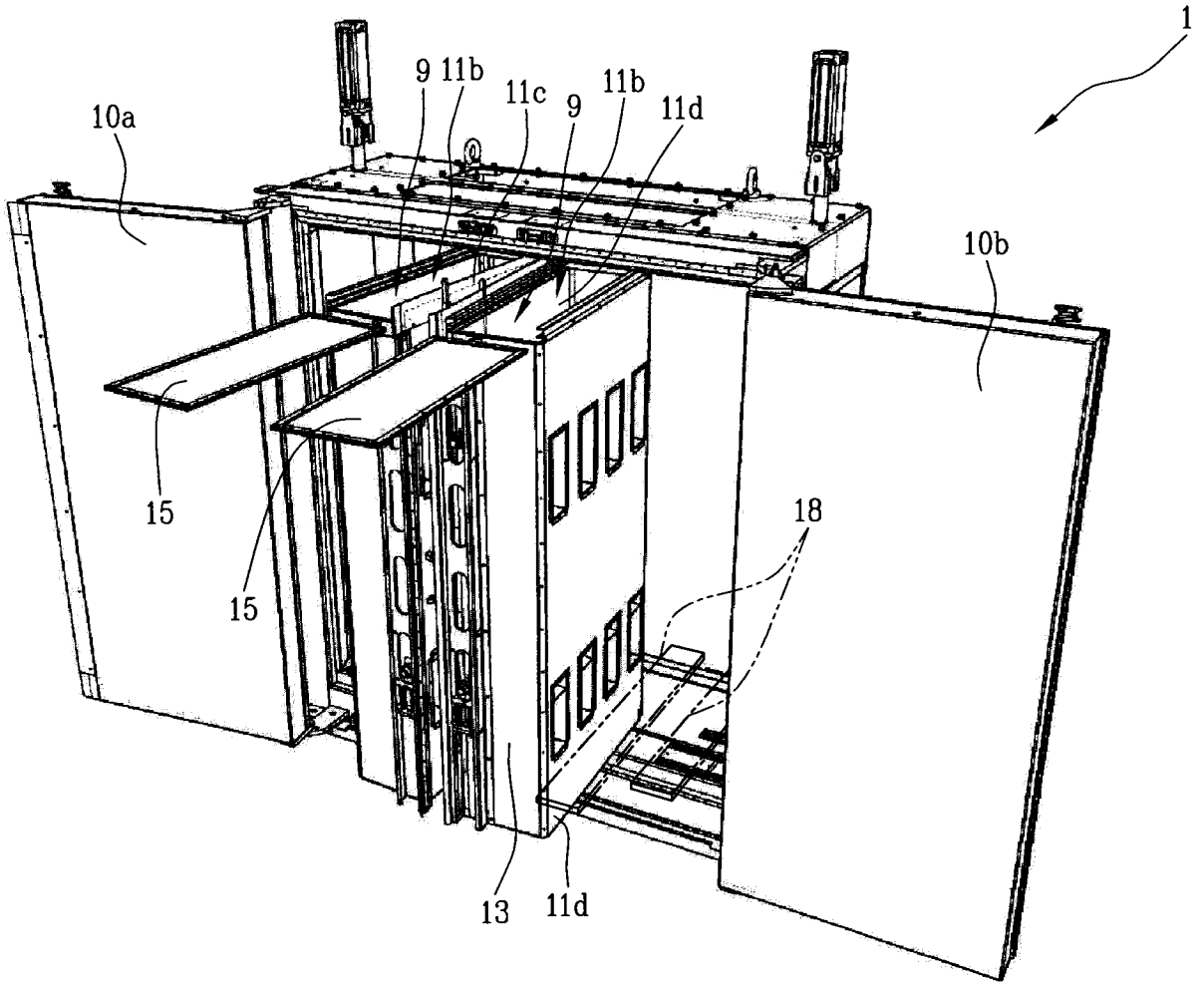

Preferably, as illustrated in FIG. 5 and in FIG. 6, the second gap 9 is delimited by containment walls 11*a* and 11*b*.

The containment walls 11*a* and 11*b* are divided into two portions 11*c* and 11*d* defining an inner door 12 which can be opened for accessing inside the module 1.

The inner door 12 is preferably of the type with a single central hinge 23.

More specifically, the inner door 12 is configured for opening by moving the containment walls 11*a* and 11*b* so that they rotate as illustrated in FIG. 6.

In other words, when the inner door 12 is open, the two portions 11*c* and 11*d* of the containment wall 11*b* are positioned substantially parallel and facing each other.

Preferably, the portions 11*c* and 11*d* of the containment walls 11*a* and 11*b* have at least one partition 13 positioned inside the second gap 9. The second gap 9 also comprises means for selecting the passage of air flow 4.

The selection means 14 can be configured in a first configuration wherein the air 4 flow is allowed between the first gap 8 and the treatment chamber 6.

In this first configuration the flow of air 4 is prevented between the treatment chamber 6 and the second gap 9.

The selection means 14 can also be configured in a second configuration wherein the flow of air 4 is prevented between the first gap 8 and the treatment chamber 6 whilst the flow is allowed between the treatment chamber 6 and the second gap 9.

The second gap 9 comprises filters 15 for filtering the flow of air 4. Preferably, the filters 15 are located in the vicinity of the fan unit 2.

When the flow of hot air 4 passes through the fibres it can carry with it remains of the fibres: the filters 15 are configured to prevent the fibres being carried by the flow of air 4 from in some way clogging the fan unit 3 and the burner 2.

The filters 15 are preferably removable to allow the operator to clean them easily when the inner door 12 is open.

More specifically, an upper portion of the second gap 9 (the one close to the fan unit 2) is shaped to allow the filters 15 to be withdrawn when the cleaning is necessary.

The module 1 also comprises a first platform 16 and a second platform 17 positioned in such a way as to define below and above the treatment chamber 6.

In other words, the first platform 16 and the second platform 17 are positioned horizontally one above the other at a predetermined distance from each other defining the height of the treatment chamber 6.

In this way, the treatment chamber 6 is delimited laterally by the side panels 7*a*, 7*b*, below by the first platform 16 and above by the second platform 17.

The treatment chamber 6 is open in the front and rear directions to allow access to the fibres to be treated.

Each platform 16, 17 has a plurality of first and second channels labelled, respectively, 16*a* and 17*a*.

The first and second channels 16*a* and 17*a* are positioned in fluid communication with the first gap 8 and the second gap 9 of each side panel 7*a* and 7*b*.

Moreover, the first channels 16*a* and the second channels 17*a* are in flow communication with the treatment chamber 6 to define connecting portions of the closed path 5.

More specifically, the first channels 16*a* and the second channels 17*a* are shaped in such a way as to allow the air flow 4 to enter or leave the treatment chamber 6.

In accordance with a possible embodiment, the fluid connecting portion between the above-mentioned channels 16*a* and 17*a* with the treatment chamber 6 can comprise means 18 for increasing or decreasing the operating pressure of the flow 4.

The choice of the means 18 is relative to the operating mode which the user wants to use and the type of material with which the fibres are made.

More specifically, a means for varying the operating pressure 18 is provided for each first and second channel 16*a*, 17*a*.

The pressure variation means 18 are removable to allow an operator to vary the operating mode of the module 1.

According to a possible embodiment, the selecting means described above comprise a first set of openings 14*a* made in the containment walls 11*a*, 11*b* and leading in the first channels 16*a* and a second set of openings 14*b* made in the containment walls 11*a*, 11*b* leading in the second channels 17*a*.

In use, the selecting means, as mentioned above, can be configured in the first configuration wherein the passage of the air flow 4 is allowed between the first gap 8 and the treatment chamber 6 and wherein the passage of the air flow 4 is prevented between the treatment chamber 6 and the second gap 9 and in the second configuration wherein the flow of air 4 is prevented between the first gap 8 and the treatment chamber 6 and wherein the flow is allowed between the treatment chamber 6 and the second gap 9.

FIG. 2 shows a possible configuration wherein the openings 14*b* are configured to prevent the flow of air 4 between the first gap 8 and the treatment chamber 6 whilst the openings 14*a* are configured to allow this passage.

In this configuration the flow of air 4 will follow the closed path in such a way as to strike the fibres from the bottom upwards and then enter in the second gap 9 and from there be conveyed again to the fan unit 3 (and consequently to the burner 2), and then pass again along the path just described.

FIG. 3 shows a second possible configuration wherein the openings 14*b* are configured to allow the passage of the flow of air 4 from the first gap 8 to the treatment chamber 6 whilst the openings 14*a* are configured to allow the passage of the flow of air 4 from the treatment chamber 6 to the second gap 9.

In this configuration the flow of air 4 will follow the closed path in such a way as to strike the fibres from the top downwards and then be conveyed again to the fan unit 3 and to the burner 2.

The configuration of the module 1 allows an air flow 4 which is homogeneous and which allows the fibres to be uniformly treated.

The selecting means may be set according to the first configuration in a first portion of the gaps corresponding substantially with a hinge of the outer door 10 and according to the second configuration in a second portion of the gaps corresponding substantially to the other hinge of the outer door 10.

In this way, at least as regards the flows, the first gap 8 and the second gap 9 are functionally divided in such a way as to have two closed paths on each side panel 7*a*, 7*b*.

In this way it is possible to alternate the passage from the bottom upwards or from the top downwards of the air flow 4 along the path of the fibres inside the module 1.

The above description may also be applied to the case if the module is equipped with a heat dissipater in place of the burner 2.

Figure 7:
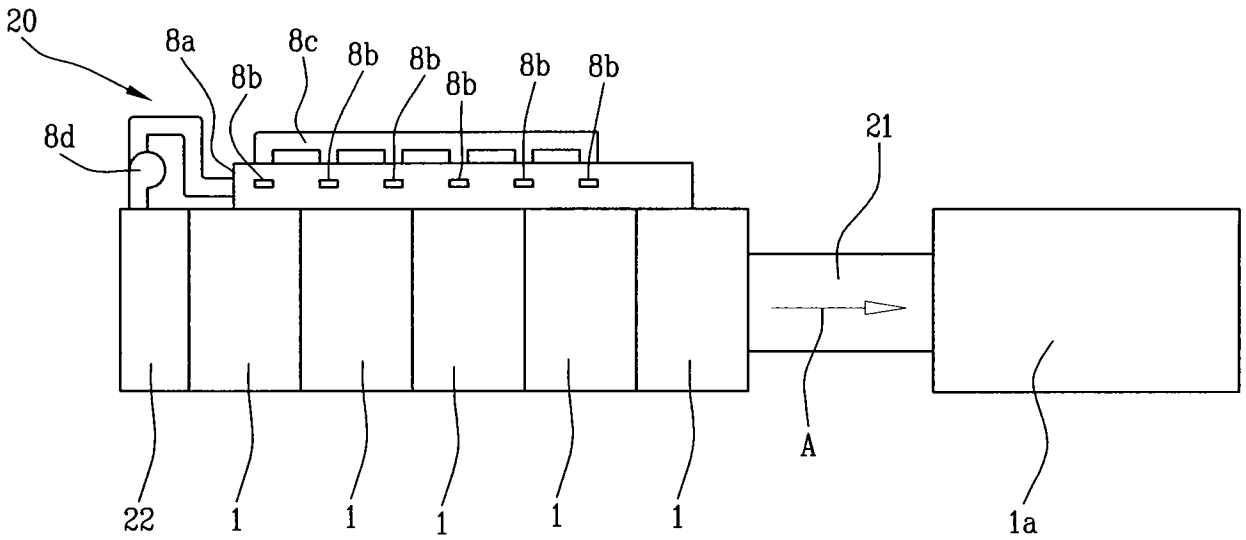
FIG. 7 is a schematic view of the system according to the invention.

In this case, it is therefore a module for cooling the fabric which for simplicity will be referred to as module 1*a*, shown schematically in FIG. 7.

The heat dissipater is located near the fan unit 3, so the module is designed to act as module for cooling the fibres.

The invention also relates to a system 20 for the treatment of fibres for obtaining a non-woven fabric.

The system 20, schematically illustrated in FIG. 7, comprises in succession at least one preheating station 22, at least one module 1 for heating the fibres and at least one module 1*a* for cooling the fibres.

The system 20 also comprises means 21 for feeding the fibres through the heating module 1 and for feeding the fabric obtained from the fibres through the cooling module 1*a*.

More specifically, the system 20 will comprise a set of modules 1 for heating the fibres (in FIG. 7 there are five modules 1) in which each module can be configured in a different way for treating the fibres.

There is then at least one module 1*a* for cooling the non-woven fabric configured for removing heat from the fabric to prevent the heat accumulated by the fibres from modifying the quality achieved by the thermal treatment.

In FIG. 7 the feeding of the fibres/fabric occurs from left to right according to the arrow A.

In the set of modules 1, 1*a* the treatment chambers 6 are positioned in communication with each other by means of the respective front openings.

The module 1 and the system 20 as described in the embodiments allow, thanks to its symmetrical structure of the modules 1, 1*a* for heating or cooling the fibres uniformly, consequently overcome the problems of the prior art.

Advantageously, the arrangement of the gaps 8 and 9 of the fan unit 3 and of the burner 2 (or of the heat dissipater) makes it possible to generate a uniform and constant flow of air 4 which uniformly strikes the fibres in the treatment chamber 6.

Still more advantageously, the division of the modules 1, 1*a* into two halves allows a greater uniformity of the thermal treatment of the fibres in the treatment chamber 6 for obtaining a non-woven fabric.

Moreover, the structure of the module 1, 1*a* with the presence of the outer door 10 and the inner door 12, advantageously allows a facilitated maintenance by an operator making it possible to act on both faces 7*a* and 7*b* of the modules 1, 1*a*. In effect, by opening all the outer doors and all the inner doors access is gained from side to side to the treatment chamber transversely to the feed direction of the fibres, allowing cleaning both of the first and second channels 16*a* and 17*a* and of the gaps 8 and 9.

Moreover, the presence of means 18 for varying the pressure makes the module 1 or 1*a* suitable for a multiplicity of processing methods and types of materials of the fibres with their simple replacement.

The invention claimed is:

1. A module for the treatment of fibers for obtaining a non-woven fabric, comprising:

a fan unit configured to generate a flow of air through a closed path, a treatment chamber for treatment of the fibers positioned in fluid communication with the closed path, wherein the treatment chamber is delimited on opposite sides by respective side panels, wherein each of the side panels comprises a first gap defining a blowing portion of the closed path and a second gap defining a suction portion of the closed path, each of the side panels defining a branch of the closed path which extends between the fan unit and the treatment chamber, a first platform and a second platform comprising respective first and second channels placed in fluid communication with the first gap and second gap of each of the side panels and with the treatment chamber to define connecting portions of the closed path, containment walls delimiting the second gap, the containment walls divided into two portions defining an inner door which is configured to be opened for accessing inside the module, wherein the two portions of the containment walls comprise at least one partition positioned inside the second gap, an outer door delimiting the first gap, the outer door configured to be opened for accessing inside the module, wherein the second is positioned between the first gap and the treatment chamber, wherein the second gap comprises a selection device including a plurality of openings selectively openable and closeable for selecting passage of the air flow and configurable between a first configuration wherein the flow is allowed between the first gap and the treatment chamber whilst the flow is prevented between the treatment chamber and the second gap, and a second configuration wherein the flow is prevented between the first gap and the treatment chamber whilst the flow is allowed between the treatment chamber and the second gap, wherein the fan unit is positioned equidistant relative to the treatment chamber in such a way that the flow of air is divided symmetrically between branches of the closed path, a burner positioned at the fan unit, whereby the module is configured as a module for heating the fibers.

2. The module according to claim 1, wherein the inner door includes single central hinge.

3. The module according to claim 1, wherein the plurality of openings includes a first set of openings leading into the first channels and a second set of openings leading into the second channels.

4. The module according to claim 1, comprising a pressure varying device for varying a pressure of the air flow, the pressure varying device being removable and positioned at the first channel and the second channel.

5. The module according to claim 1, wherein the second gap comprises removable filters for filtering the air flow.

6. The module according to claim 1, wherein the fan unit is positioned above the treatment chamber in such a way as to form a closed path shaped as a portal.

7. The module according to claim 1, wherein the first gap is delimited by a base surface including recovery openings for recovering a portion of the air flow positioned in fluid communication with a recovery duct comprising an adjustable suction unit for regulating a quantity of the portion of the air flow recovered.

8. The module according to claim 1, and further comprising a heat dissipater positioned close to the fan unit, whereby the module is configured as a module for cooling the fabric.

9. A system for the treatment of fibers for obtaining a non-woven fabric comprising in succession the module according to claim 8 configured for cooling the fibers and a feeding system including a duct for feeding the fibers and the fabric obtained along the system.

10. A system for the treatment of fibers for obtaining a non-woven fabric comprising in succession the module according to claim 1 configured for heating the fibers.

* * * * *